United States Patent [19]

Rajczi

[11] 4,154,024

[45] May 15, 1979

[54] ELECTRIC CONTROL DEVICE FOR AN AUTOMATIC GRINDING MACHINE

[75] Inventor: Frank D. Rajczi, Hyde Park, N.Y.

[73] Assignee: Schatz Federal Bearings Co., Inc., Poughkeepsie, N.Y.

[21] Appl. No.: 843,361

[22] Filed: Oct. 19, 1977

[51] Int. Cl.[2] ..... B24B 49/10

[52] U.S. Cl. ..... 51/165 R; 51/165.74

[58] Field of Search ..... 51/165 R, 165.77, 165.74, 51/165.87, 165.88, 2 Z, 2 AA, 2 C; 125/11 R

[56] References Cited

U.S. PATENT DOCUMENTS

| | | | |
|---|---|---|---|
| 2,023,494 | 12/1935 | Strieby | 51/2 C |
| 2,340,843 | 2/1944 | Bailey | 51/2 AA |
| 2,504,026 | 4/1950 | Krause | 51/2 Z |
| 2,866,301 | 12/1958 | Koulicovitch | 51/165 R |
| 3,095,532 | 6/1963 | Floyd | 51/165 R X |
| 3,160,870 | 12/1964 | Randall | 51/165.74 X |

*Primary Examiner*—Harold D. Whitehead
*Attorney, Agent, or Firm*—Hopgood, Calimafde, Kalil, Blaustein & Lieberman

[57] ABSTRACT

Apparatus for detecting irregularities in an automated machine grinding procedure, the grinding machine including a workpiece, a chuck for holding the workpiece, and a grinding wheel controllably applied to the workpiece for removing a predetermined amount of material therefrom. A vibration-sensitive device mounted at a predetermined distance from the workpiece location converts mechanical vibration resulting from the interaction of the workpiece and the grinding wheel into electrical signals. The magnitude of the electrical signals is directly proportional to the level of vibration such that excessive vibration, resulting from irregularities in the grinding procedure, results in an increased electrical signal magnitude. A predetermined electrical signal magnitude is detected and in response thereto associated control circuitry is operated which terminates the grinding procedure. The grinding procedure is terminated during the grinding cycle but before the workpiece is rejected from the grinding chuck thereby ensuring that manual intervention can be utilized to check the accuracy of the workpiece before rejection. The vibration level, to which the detection circuitry is responsive, can be preset in response to control signals from the grinding machine.

8 Claims, 2 Drawing Figures

ELECTRIC CONTROL DEVICE FOR AN AUTOMATIC GRINDING MACHINE

FIELD OF THE INVENTION

This invention relates to electronic control devices and, more particularly, to an electronic control device for automatic grinding machines and similar machines which produce vibrations in the course of their operation.

BACKGROUND OF THE INVENTION

Grinding machines are utilized to cut, grind and/or polish metals or other types of materials. Such grinding machines are widely used in industry and take the form of both rough grinding and precision grinding apparatus. Every grinding machine, regardless of type, operates in essentially the same manner, that is, a grinding wheel is applied to a workpiece and the grinding wheel is controlled to remove a predetermined amount of material from the workpiece.

In any grinding procedure, and especially in precision grinding procedures, it is critical that irregularities in the grinding procedure be detected quickly. Such irregularities include excessive or uneven wear of the grinding wheel, unexpected hardness or flaws in the workpiece and malfunctions in the grinding machine apparatus itself. Irregularities of this type are often evidenced by excessive vibration of the workpiece and/or the grinding wheel. Such irregularities, especially in precision grinding procedures, can result in damage to the workpiece which may render the workpiece unsuitable for its intended use.

One solution to the problem of detecting irregularities in a grinding procedure has been the utilization of skilled machine operators to monitor the procedure and to take preventive action upon detection of irregularities or malfunctions. The use of a machine operator to monitor work progress obviously adds large additional expense to manufacturing cost but this additional expense has often been necessary due to the complex and expensive nature of the workpiece and the danger of damage thereto.

It is therefore an object of this invention to detect irregularities in a grinding procedure and to take action in response thereto which will prevent damage to the workpiece being ground.

It is another object of this invention to detect irregularities in a grinding procedure without requiring the use of a skilled machine operator to monitor work progress.

Elimination of grinding machine operators for monitoring work progress has been accomplished in the prior art through the use of electrical or electronic control circuits to control the grinding procedures. One such control circuit is illustrated by U.S. Pat. No. 3,650,074 granted to E. A. Weinz on Mar. 21, 1972. The invention described in this patent relates to a precision grinding machine and control circuit therefor, the grinding machine being utilized to grind and polish single crystal materials such as diamonds. This patent indicates that a problem in the prior art has been the fact that while grinding single crystal material it is necessary to orientate the workpiece such that the cutting or grinding takes place along a preferred axis of the material which is in the direction of least mechanical resistance. This problem was previously overcome by employing skilled workmen to monitor the grinding process and to ensure that the grinding process was proceeding along the preferred axes.

The use of skilled workmen is eliminated by the control circuit in this patent which utilizes a vibration transducer to detect vibrations occurring during the grinding procedure. When grinding along the preferred axis of the material, grinding vibrations are at a minimum and, conversely, while grinding along a non-preferred axis, grinding vibrations are greatly increased. The transducer or pick-up device detects the vibrations occurring during grinding and this signal is transmitted to detection circuitry calibrated to rotate the workpiece being ground in response to a predetermined level of vibration. More particularly, if the piece is orientated such that the grinding is occurring along the now-preferred axis of the material, vibrations will be at a high level and will be detected by the detection circuitry. The detection circuitry, in response to this high vibration level, operates a motor to rotate a shaft connected to the workpiece. The rotation occurs at a slow rate and continues until the vibration level decreases to a predetermined safe level thereby indicating grinding along the preferred axis of the material.

The control circuit described in this patent, although providing grinding machine control, does not detect irregularities in the grinding procedure such as grinding wheel wear or malfunction of the grinding apparatus, nor does this control circuit function to prevent damage to the workpiece resulting from such irregularities. Rather, the control circuit simply detects an increase in machine vibration and rotates the workpiece in response thereto. In addition, the vibration-sensitive transducer utilized in the patent is located quite near the grinding surface area thereby subjecting the transducer to workpiece fragments from the material being ground which may damage the vibration transducer.

It is therefore another object of this invention to provide an electronic control circuit for an automatic grinding machine that will detect irregularities in the grinding procedure and, more importantly, will prevent damage to the workpiece resulting from these irregularities.

It is a further object of this invention to provide an electronic control circuit for an automatic grinding machine which is capable of detecting variations in precision grinding procedures.

It is a further object of this invention to provide an electronic control circuit for an automatic grinding machine that utilizes a transducer which is not subject to damage or reduced efficiency resulting from workpiece fragments.

It is a further and general object of this invention to provide an electronic control circuit for an automatic grinding machine which is both inexpensive and precise in operation.

SUMMARY OF THE INVENTION

In accordance with the invention apparatus is provided to detect irregularities in an automated machine grinding procedure, the grinding machine including a workpiece and a grinding wheel controllably applied to the workpiece for removing a predetermined amount of material therefrom. A vibration-sensitive device, mounted a prescribed safe distance from the workpiece location, converts mechanical vibrations resulting from the interaction of the workpiece and the grinding wheel into electrical signals. The magnitude of the electrical signal output from the vibration-sensitive device is directly proportional to the level of vibration. The electrical signal output is detected and apparatus responsive to a predetermined electrical signal magnitude disables the grinding machine when vibration levels reach the predetermined magnitude.

It is a feature of the invention that, upon detecting the predetermined level of vibration, the grinding machine operation is terminated thereby preventing damage to the workpiece currently being ground.

It is another feature of the invention that, when the grinding procedure is terminated, the workpiece is held within the grinding machine chuck and is not discarded into an area containing previously ground workpieces.

It is another feature of the invention that the vibration sensitive device is located a predetermined safe distance from the workpiece area such that the vibration-sensitive device is not affected by material removed from the workpiece during the grinding procedure.

The foregoing and other objects and features of this invention will be more fully understood from the following description of an illustrative embodiment thereof taken in conjunction with the accompanying drawings.

DETAILED DESCRIPTION

Figure 1:
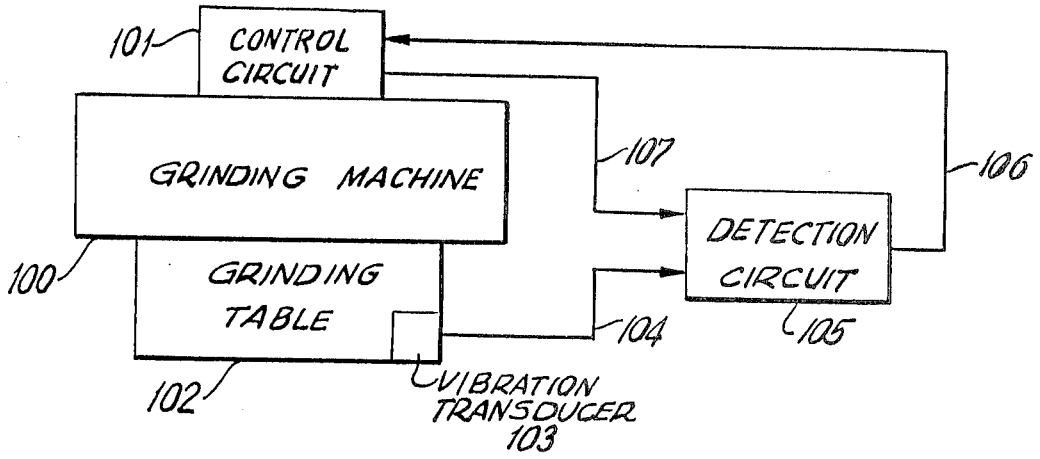
FIG. 1 illustrates, in block diagram form, an automatic grinding machine utilizing the electronic control circuit of the instant invention.

Refer to FIG. 1. Therein is illustrated a generalized block diagram of a grinding machine utilizing the electronic control circuitry of the instant invention. Grinding machine 100, indicated in block diagram form, can be of any type of standard grinding machine. Standard grinding machines are known in the art and, therefore, it is not necessary to elaborate on the details of such grinding machines. The grinding machine shown in FIG. 1 includes control circuit 101 which monitors various control functions internal to the machine. Such control circuitry is a normal part of standard grinding machines and functions to provide basic control features which can include an internal relay which stops the machine during the grinding procedure without ejecting the workpiece from the grinding chuck and an internal relay utilized to advance the grinding machine through both rough and precision grinding cycles.

Grinding table 102 is part of the grinding machine and is illustrative of the grinding table upon which the grinding procedure is accomplished. It is to be understood that the grinding table is not necessarily attached to the grinding machine in the manner indicated in FIG. 1. Rather, FIG. 1 merely illustrates the fact that a grinding machine normally has a grinding table upon which the grinding procedure is performed.

Attached to grinding table 102 is vibration transducer 103. The vibration transducer is utilized to detect unusual or excessive amounts of vibration occuring during the grinding procedure. Although FIG. 1 shows vibration transducer 103 as being connected to the grinding table, it is to be understood that the vibration transducer can be mounted in various locations on the grinding machine. The only requirement for the mounting of the vibration transducer is that the transducer must be mounted a sufficient distance away from the grinding area such that the transducer is not subject to contamination and/or damage due to excess material projected from the grinding area due to the grinding procedure. Vibration transducer 103 converts the mechanical vibrations resulting from the interaction of the workpiece and the grinding wheel into electrical signals. Such transducers are well known in the art and can be purchased commercially.

The electrical signal output from the vibration transducer is applied via path 104 to detection circuit 105. The detection circuit amplifies the electrical signal originating from the vibration transducer and more importantly, the detection circuit is precalibrated to detect a certain excessive magnitude of the electrical signal which results from excess levels of vibration during the grinding procedure. More particularly, during normal operation of the grinding procedure, the grinding machine is allowed to operate without disruption of the grinding routine. However, when the vibration level increases, it indicates that there are irregularities occurring in the grinding procesdure. The occurrence of the irregularities, and the corresponding excessive vibration, results in an increased electrical signal output from vibration transducer 103. This electrical signal output is communicated to the detection circuitry via path 104 and the detection circuitry detects this increased electrical signal magnitude and, in response thereto, applies a control signal via path 106 to control circuit 101. The control signal enables control circuit 101 and in response thereto the control circuit advantageously stops the grinding machine at the end of the grinding cycle. Termination of the grinding procedure at the end of the grinding cycle ensures that the workpiece is retained in the machine chuck and is not rejected. Retaining the suspect workpiece within the grinding chuck is important since this workpiece may be damaged and it is necessary to allow an operator to intervene and check the accuracy of the piece being ground before the piece is ejected and allowed to mix with previously ground pieces. The detection circuitry also contains indication lights as will be hereinafter described which signal to a manual operator that a malfunction has occurred.

As indicated above, control circuit 101 is capable of operating the grinding machine in both a rough grind and a precision grind mode. Control signals, distinguishing between the rough grind and precision grind mode, are applied via path 107 to detection circuit 105. Such control signals may, for example, take the form of a relay closure and as will be hereinafter described these signals enable detection circuit 105 during a precision grind mode of operation and disable circuit 105 during a rough grind mode of operation or vice versa. In this manner, the detection circuit can, for example, be disabled during a rough grind procedure and enabled during a precision grind procedure so as to ensure that no irregularities or malfunctions occur during the critical precision grinding procedure. Alternatively, of course, the control signal on path 107 could be utilized to enable the detection circuitry during a rough grind procedure so as to monitor the procedure during the internal in which a large amount of material is being removed from the workpiece and there is greater opportunity for malfunction. After the rough grind procedure, the control signal on path 107 can be utilized to disable the detection circuitry allowing the precision grind procedure to operate in an uninterrupted manner. In addition, the control signal can be utilized to enable the detection circuitry to monitor both a rough grind and a precision grind procedure. In this mode of operation, the detection circuitry will ensure that the rough grind procedure is monitored in a coarse sense and thereafter the sensitivity of the detection circuitry can be increased during the precision grind procedure allowing precision grinding to be monitored in a more accurate sense.

Figure 2:
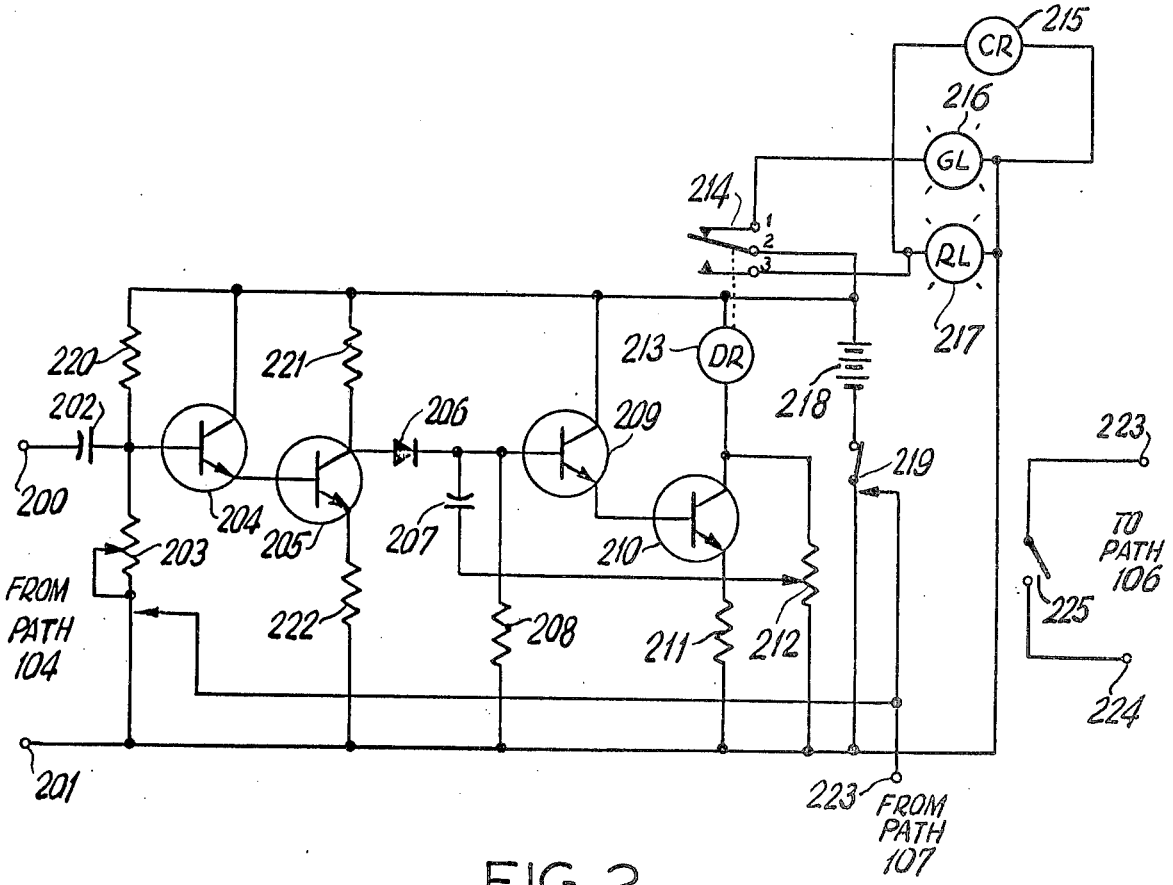
FIG. 2 illustrates a schematic diagram of the detection and control circuitry of the instant invention.

Refer now to FIG. 2. Therein is shown detection circuit 105. The electrical signal generated by vibration transducer 103, and applied to the detection circuitry via path 104, is received on terminals 200 and 201. The control signal generated by control circuitry 101 and applied to the detection circuitry via path 107 is applied to the detection circuitry at terminal 223. Similarly, the control signal generated by the detection circuitry and applied to control circuitry 101 via path 106 is applied to path 106 via terminals 223 and 224.

The electrical signal originating from vibration transducer 103 is applied to terminals 200 and 201 from there via capacitor 202 to an amplifier consisting of transistors 204, 205, resistors 220, 221, 222 and potentiometer 203. Potentiometer 203 adjusts the sensitivity level of the amplifier in a well known manner and is utilized to increase or decrease the sensitivity of the amplifier such that the amplifier will amplify to a greater or lesser extent the input signal received on terminal 200 and applied to the amplifier via capacitor 202.

The amplified electrical signal from the vibration transducer is half-wave rectified by diode 206. This rectified signal is applied to an RC circuit comprised of capacitor 207 and potentiometer 212. Capacitor 207 begins to charge in response to the rectified signal and creates a positive voltage across resistor 208. When the positive voltage reaches a predetermined level, transistor 209 is turned on. Turning on transistor 209, applies an enabling current to transistor 210 which turns this transistor on. This creates a path from power supply 218 to ground via the coil of relay 213, transistor 210 and resistor 211.

It is clear that transistor 210 will only be turned on when the amplified and rectified signals applied to terminal 200 are of sufficient magnitude to charge capacitor 207 to such a level as to turn on transistor 209. The magnitude of the amplifier output is determined by potentiometer 203 as has been described above. Potentiometer 203 can be preset to such a level that capacitor 207 will only become charged in response to a predetermined output signal from transducer 103. Therefore, varying the setting of potentiometer 203 ensures that when the vibration occurring in the grinding machine reaches a certain predetermined level, a signal of sufficient strength will be amplified and applied to capacitor 207, allowing the capacitor to charge, thereby turning on transistors 209 and 210 as described above. The time necessary to charge capacitor 207 to the voltage required to operate transistor 209 is determined by adjusting potentiometer 212. Therefore, appropriate adjustment of potentiometer 212 will determine the response time of the detection circuit.

Turning on transistor 210 operates relay 213 by providing a path from the positive voltage supply through the relay to ground as described above. Contacts 214, the contacts for relay 213, normally complete a path between terminal 2 and terminal 1, applying a positive voltage from power supply 218 to light 216. Therefore, when relay 213 is not operated, light 216 is on giving a green indication to the operator which indicates that the grinding procedure is proceeding normally. When the vibration level and the resultant electrical signal reaches the predetermined magnitude described above, relay 213 is operated and contacts 214 provide a path between terminals 2 and 3. In this configuration, positive voltage is supplied via terminals 2 and 3 to red light 217 and also to control relay 215 while at the same time disabling light 216. Operation of light 217 gives a red indication to the operator indicating that a grinding malfunction has occurred. Simultaneously therewith, relay 215 is operated which closes contact 225. Contact 225 provides a path between terminals 223 and 224 which are extended to control circuitry 101 via path 106. Therefore, operation of contact 225 is an indication to the control circuitry that a malfunction has been detected during the grinding procedure.

Control circuitry 101, in response to the contact closure of relay contact 225 operates an additional relay (not shown) which is internal to the grinding machine and functions to terminate the grinding procedure at the end of the grinding cycle in the manner described above. Terminating the grinding procedure at the end of the grinding cycle prevents the workpiece being ground from being rejected from the grinding chuck. At the same time, light 217 gives a red or danger indication to the operator who can then manually check the workpiece retained within the chuck for damage.

Once the grinding procedure is terminated the excess vibrations from the grinding machine will cease thereby reducing the magnitude of the signal present at terminals 200 and 201. At this time the output of transistor 205 will also be reduced allowing capacitor 207 to begin discharging through resistor 208. The discharge time of capacitor 207 is determined by the setting of potentiometer 203 and once the capacitor has sufficiently discharged transistor 209 and 210 will be turned off thereby disabling relay 213 and preparing the circuit for subsequent detection operation.

As described above, a standard function of grinding machine control circuits is their ability to generate a control signal indicating the grinding stages of the grinding machine. More particularly, such a signal may be generated by circuit 101 and serve to indicate whether the grinding machine is in a rough or a finish grind cycle. The control signal is applied via path 107 to terminal 223 in FIG. 2. The control signal can be used in a number of ways as schematically indicated in FIG. 2. For example, the control signal can be utilized to operate switch 219, thereby disabling the detection circuitry during a rough grinding procedure or, alternatively, can be utilized to disable the detection circuitry during a finish grinding procedure. In this configuration, potentiometer 203 would be manually set to either detect the vibration levels occurring during a rough or a finish grinding procedure and switch 209 would be enabled or disabled during the rough or finish grinding procedure, respectively to thereby provide control during either cycle.

It can also be appreciated that the control signal generated by the control circuitry, in conjunction with adequate interface circuitry (not shown), can be utilized to generate a signal which will mechanically operate potentiometer 203. More particularly, assuming the ability to mechanically adjust potentiometer 203 throughout its intended range the control signal from path 107 can be utilized to adjust potentiometer 203 to detect the vibration level occurring during a rough grinding procedure or can be utilized to readjust potentiometer 203 to detect the vibration levels occurring during a precision grinding procedure. In this mode of operation, therefore, the detection circuitry of the instant invention can be utilized to continually monitor both a rough grind and a precision grind procedure by simply automatically changing the setting of potentiometer 203. Alternatively, potentiometer 203 could be replaced by separate resistors which would be switched into the circuit in response to the rough or precision grind mode to thereby set the sensitivity of the detection circuitry and allow it to continuously monitor both modes of operation.

The instant invention, therefore, has illustrated a means of controlling a grinding machine and, more particularly, the instant invention has illustrated apparatus to terminate the grinding procedure in the presence of excessive vibrations which are indicative of grinding malfunctions. The instant invention terminates the grinding procedure at the completion of the grinding cycle while ensuring that the workpiece being operated on is not rejected from the grinding chuck, allowing the piece to be checked by an operator. Simultaneously, with stopping the grinding machine, a red or danger indication is provided to the operator which alerts the operator to a malfunction and allows him to proceed to check the workpiece. The instant invention also advantageously provides a means by which a grinding machine can be monitored throughout a grinding procedure in that the detection circuitry can be adjusted to detect vibration levels occurring during rough grinding procedures and vibration levels occurring during finish grinding procedures. As described above, this is possible through the adjustment of potentiometer 203 in response to control signals from control circuit 101.

Although a specific embodiment of this invention has been shown and described, it will be understood that various modifications may be made without departing from the spirit of this invention. More particularly, the instant invention can be utilized in a variety of applications, including utilization as a balance indicator for motors and other running equipment, a precision instrument to adjust brakes, clutches and so on, an indicator for lack of lubrication in running machinery, to check the motion of moving material in printing presses, movement of cam levers and so on. All of the aforementioned applications relate to the detection of irregularities in the operation of vibration-producing machinery, a function readily achieved by the advantages inherent in the instant invention.

I claim:

1. Apparatus for detecting irregularities in an automated machine grinding procedure, the grinding machine including a workpiece, a chuck for holding the workpiece, and a grinding wheel controllably applied to the workpiece for removing a predetermined amount of material therefrom, the apparatus comprising a vibration-sensitive device, mounted a predetermined distance from the workpiece location for converting mechanical vibrations resulting from the interaction of the workpiece and the grinding wheel into electrical signals, the magnitude of the electrical signals being directly proportional to the level of vibration, means responsive to increases in signal magnitude for detecting a buildup in said signal magnitude from a first acceptable signal level to a second excessive signal level, said acceptable signal level being less than said excessive signal level, said detecting means being operable within a predetermined and variable interval of time subsequent to the time said signals are applied to said detecting means, and means responsive to said signal magnitude attaining said excessive level for terminating the grinding procedure while retaining the workpiece within the chuck of the grinding machine.

2. Apparatus in accordance with claim 1, wherein the detecting means includes means for amplifying the electrical signals, means connected to the amplifying means for rectifying the electrical signals, and means responsive to the rectified electrical signals for operating a relay contact, said relay contact providing a signal to terminate the grinding procedure.

3. Apparatus in accordance with claim 2, wherein the amplifying means includes adjustable resistive means for varying the gain of the amplifying means throughout a predetermined range.

4. Apparatus in accordance with claim 2, wherein the operating means includes means for producing an enabling voltage level in response to the excessive electrical signal magnitude, and transistor switching means being enabled in response to the produced enabling voltage for operating the relay contact.

5. Apparatus in accordance with claim 3, wherein said resistive means are adjustable in response to control signals produced by the grinding machine.

6. Apparatus in accordance with claim 2, wherein the detecting means further includes means for enabling the detecting means in response to a first control signal from the grinding machine and means for disabling the detection means in response to a second control signal from the grinding machine, whereby the occurrence of the excessive electrical signal magnitude does not result in termination of the grinding procedure at the time the detection means are disabled.

7. Apparatus in accordance with claim 6, wherein the detection means further includes means for providing a danger indication to a machine operator at the time the electrical signal magnitude reaches the excessive level, and means for providing a normal indication to the machine operator at the time the electrical signal magnitude is less than the excessive level.

8. Apparatus in accordance with claim 7 wherein said detecting means include a capacitor connected in series with a variable resistor, said capacitor accumulating said buildup in said signal magnitude at a rate determined by the value of said variable resistor, said operating means being responsive to said signal magnitude accumulation in said capacitor for operating said relay contact.

* * * * *